United States Patent [19]

Boidron

[11] 4,250,801

[45] Feb. 17, 1981

[54] CHIMNEY THROAT

[76] Inventor: Michel Boidron, 136, avenue du Médoc, Le Vigean, 33320 Eysines, France

[21] Appl. No.: 27,585

[22] Filed: Apr. 6, 1979

[30] Foreign Application Priority Data

Apr. 7, 1978 [FR] France ..... 78 10409

[51] Int. Cl.[3] ..... F23L 17/02

[52] U.S. Cl. ..... 98/59; 52/218; 110/184; 114/187; 126/120

[58] Field of Search ..... 98/58, 59, 60; 126/120, 126/121; 114/187; 110/184; 52/218

[56] References Cited

U.S. PATENT DOCUMENTS

| | | | |
|---|---|---|---|
| 1,677,914 | 7/1928 | Covert | 126/120 |
| 1,712,685 | 5/1929 | Blackburn | 52/218 |
| 1,755,771 | 4/1930 | Chambers | 126/120 |
| 2,381,178 | 8/1945 | Munyon | 98/58 |
| 2,752,691 | 7/1956 | Bender | 52/218 |
| 2,926,517 | 3/1960 | Simpson | 52/218 |

FOREIGN PATENT DOCUMENTS

| | | | |
|---|---|---|---|
| 661656 | 11/1961 | Canada | 126/120 |
| 2339215 | 2/1975 | Fed. Rep. of Germany | 126/120 |
| 136252 | 12/1919 | United Kingdom | 98/58 |
| 547070 | 8/1942 | United Kingdom | 126/120 |

*Primary Examiner*—Ronald C. Capossela
*Attorney, Agent, or Firm*—William A. Drucker

[57] ABSTRACT

A prefabricated metal throat, for a chimney, is assembled by simple interengagement of two identical elements of a first type with two identical elements of a second type to provide a principal body shaped as a truncated regular pyramid with a rectangular base. The elements of the first type have C-sections in planes parallel to the bases, and each forms a terminal face and two return angles of the throat. The elements of the second type join the return angles together for forming front and rear faces of the throat. The elements are cast in iron, and the second type are trapeziums in which the oblique sides are inclined to the base at an angle according to the size of the chimney, so that the horizontal parts of the C-sections do not exceed a length limit compatible with core-less moulding of the cast iron.

6 Claims, 6 Drawing Figures

CHIMNEY THROAT

BACKGROUND OF THE INVENTION

The invention relates to the prefabrication of the throats which connect the hearth of a chimney to the smoke conduit.

The known solutions have various inconveniences.

Certain throats, manufactured by means of plates of cement assembled by tenons and mortices on the site of construction of the chimney, comprise at their upper part a metallic closure element and, under these conditions, the problems of airtightness in regard to the smoke are difficult. Other models are composed of metal plates which are welded or screwed together and their assembly must be carried out in a factory, which clearly complicates the problems of transportation.

In a general manner, the known prefabricated throats are manufactured by assembly of elements which are in relatively large number, in view of the diversity of sizes, and have various practical inconveniences.

The invention seeks to reduce considerably the number of the elements which it is necessary to have in stock, to simplify the assembly with a view to permitting it to be carried out at the construction site in a short time, and to simplify transportation by providing nestable elements, the entirety of these results being obtained without complicating manufacture in the factory and whilst ensuring for the assembled product entirely satisfactory technical qualities.

The throat according to the invention is characterised in that it is obtained by assembly, by simple interengagement, of two identical elements of a first type with two identical elements of a second type, in order to constitute a principal body in the form of a truncated regular pyramid with rectangular base, the elements of the first type having C-sections in planes parallel to the bases and each forming a terminal face and two angle returns of the throat, whilst the elements of the second type join to each other the said angle returns in order to form the front and rear faces of the throat, the said elements being of moulded cast iron and the element of the second type having the form of a trapezium the oblique sides of which are more or less inclined on the base, as a function of the size of the chimney, in such a manner that the horizontal branches of the said C-sections have a length not exceeding a predetermined limit compatible with moulding of the cast iron, without coring.

According to another feature of the invention, the couplings between the branches of the said C-sections are rounded and the joints are arranged to present a smooth surface at the interior of the said principal body.

Other features, as well as the advantages of the invention, will appear clearly in the light of the following description.

DESCRIPTION OF THE PREFERRED EMBODIMENT

Figure 1:
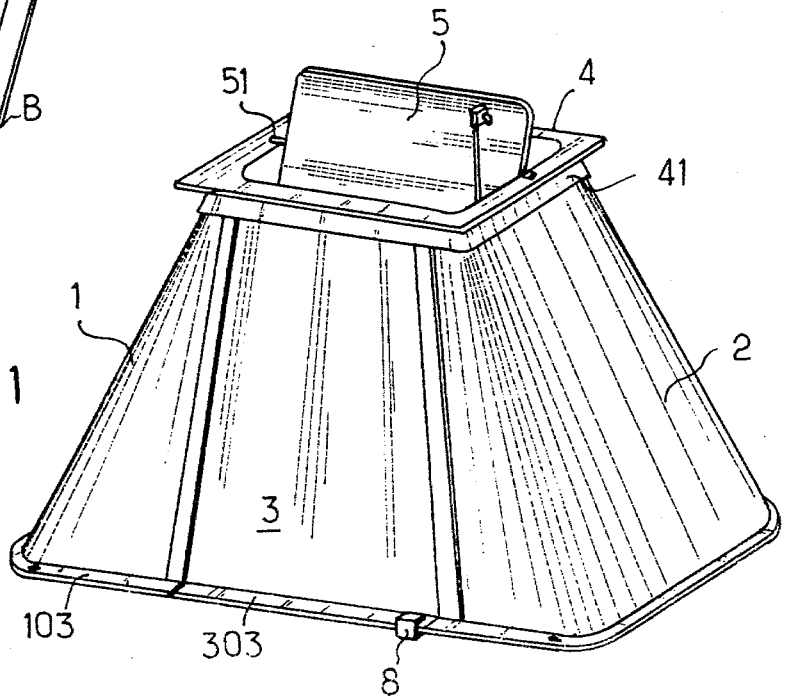
FIG. 1 is a view in perspective of a chimney throat in accordance with a preferred manner of construction.

In FIG. 1 there is shown a chimney throat of which the principal body, in the form of a truncated regular pyramid with a rectangular base, is composed of two elements 1 and 2 of the first type referred to above and of two elements of the second type, of which only that one 3, which forms part of the forward face of the throat, is visible in the drawing.

This principal body is surmounted by a frame 4 which supports a closing valve 5.

Figure 2:
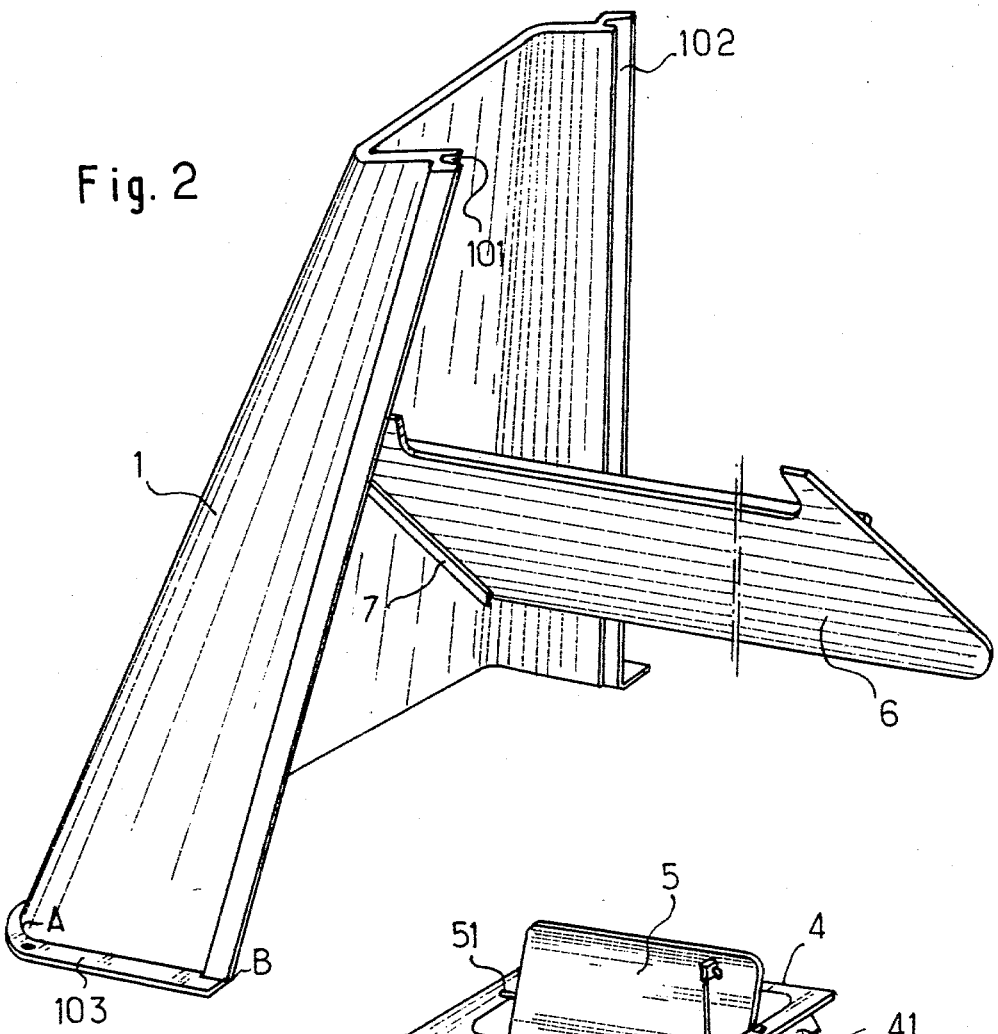
FIG. 2 is a view in perspective of an element of the first type, equipped with an anti-return flow plate.

In FIG. 2 there is shown in perspective one of the identical elements 1 or 2. It will be seen that the sections parallel to the bases have the general shape of a "C" of which the angles are rounded and of which the extremities 101-102 have the shape shown in FIG. 3, in order to provide the jointing of the element of the first type with two elements of the second type, as will be seen from the following.

Figure 5:
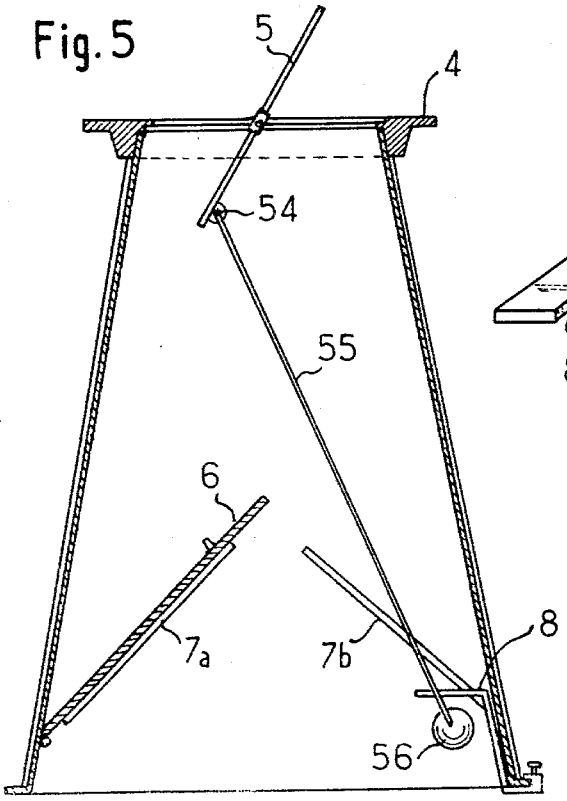
FIG. 5 is a view in transverse section of the throat.

An anti-return flow plate 6 is mounted movably on a slideway *7a*, fast with the element 1 (see also FIG. 5). It is thus put in place by simple fitting, into the slideway, of a projecting tenon with which it is provided (or vice-versa) and locked by means of claws (not shown) with which is provided the internal face of the element 3 on which the plate 6 abuts.

Its removal, easy to perform, permits the cleaning or the sweeping of the pipes and of the throat.

Figure 3:
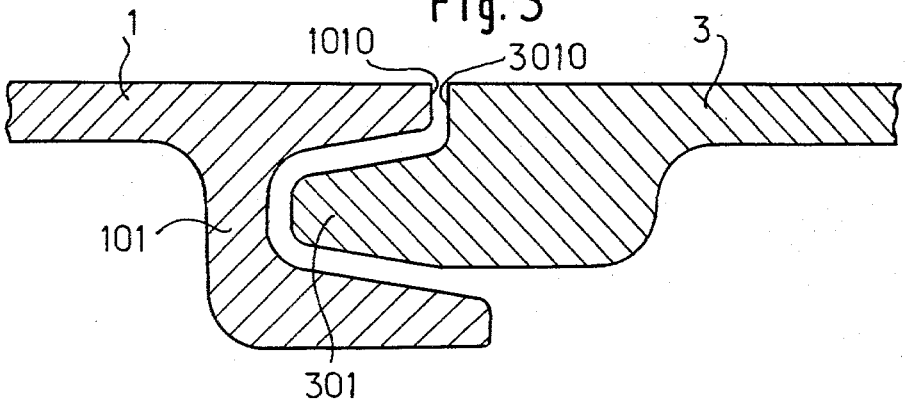
FIG. 3 is a view in horizontal section of a joint.

In FIG. 3 there has been shown in section through a plane parallel to the bases of the throat, one of the joints between the two types of elements. The element 1 forms a female part 101 while the element 3 forms a complementary projecting male part 301. It will be seen that, from the side of the internal surface of the throat, these two parts have plane surfaces disposed each in extension of the other, in such a manner as to present a smooth surface to the smoke. This feature, coupled with the rounded shape of the angles of the principal body, provides for the throat described some particularly satisfactory technical qualities; the smoke glides along without eddies.

The two complementary parts of the joint comprise a flat portion (1010-3010 respectively) which join by a rounded portion with a trapezoidal portion the angles of which are themselves rounded. Assembly is carried out in the dry state and permits the obtaining between the two parts of a sinuous gap of sufficient length to assure the airtightness in regard to the smoke, this gap being calculated so as to take into account the thermal expansion.

Returning to FIGS. 1 and 2, it will be seen that all of the elements comprise, at the periphery of their large base, an edge (103-303) bent towards the exterior. These bent edges join between themselves to form a continuous edge improving the stability during assembly and permitting the simple assembly of the masonry of the chimney.

It is clear that the throat described and shown has, as a result of its shape of a regular truncated pyramid and also by reason of the shape of the joints, an excellent stability, even before the mounting of the frame 4. This latter is provided with a skirt 41 which surmounts the external surface of the upper base of the principal body, thereby ensuring, when the throat is mounted and supports the weight of the flue tiles of the smoke conduit, automatic locking of the elements constituting the throat.

The elements and the cap 4-41 are manufactured of cast iron (cast iron having the most satisfactory qualities from the point of view of operation of a chimney throat). They are obtained by moulding without a core and, for this purpose, the joints must have a shape which lends itself to this technique of metallurgy, which is the case with that which has been shown. For the same reason, the dimension at the base of the return angles of the piece 1 must not exceed twenty cm, and that is why the the sides of the element 3 are inclined (this element thus having the shape of an isosceles trapezium). It will be noted that the frame 4 has dimensions which are standard for all sizes of chimney. The height of the principal body and the length of its large base are likewise fixed. It is the same with the dimension at the base of the return angle (A B, FIG. 2). Finally, only the inclinations of the oblique sides of the two elements will vary from one size of chimney to another, as well as the length of the base of the element 2.

The two elements constituting the front and rear faces are clearly interchangeable, and it is the same with the two elements 1 and 2.

In particular, these latter are each provided with a slideway (*7a,7b* respectively) intended to receive the anti-return flow plate.

By reason of these features, the problems of manufacture and of storage of the elements are simplified to the maximum. It will be noted that the elements of the same type are nestable. In practice, the weight of each element does not exceed twelve Kg.

Figure 4:
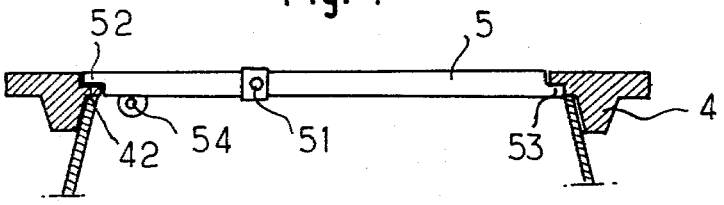
FIG. 4 is a view in transverse section of the cap of the throat and of the closing valve which it carries.

In FIG. 4 there is shown the frame 4 and the closing valve in section through a plane perpendicular to the large sides of the frame.

The valve 5 is provided with a pivoting axis 51 (see also FIG. 1) in a manner which is not shown in detail, on the small sides of the frame and offset with respect to the longitudinal axis of symmetry of the valve.

The extremity 52 of the valve which is nearer to the axis 51 forms a cheek abutting on a shoulder 42 formed by the corresponding edge of the frame, whilst the other extremity 53 forms a shoulder on which abuts a cheek formed by the corresponding edge of the frame. As a result, the valve will normally have a tendency to tilt, under the effect of its own weight, in the direction which causes its opening.

Figure 6:
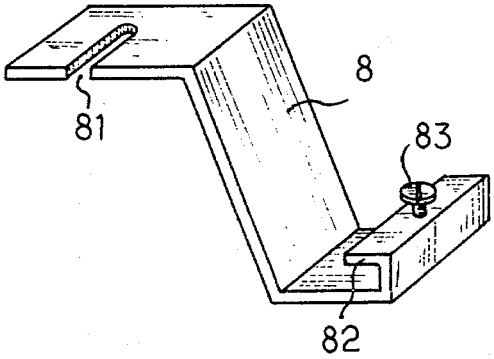
FIG. 6 shows a fixing hook for the control rod of the closing valve.

To close it, it is necessary to exert traction on a ring 54 (FIGS. 1 and 5) situated in the vicinity of the extremity 52, which is obtained by means of a rod 55 provided at its base with a handle 56 (FIG. 5). In the vicinity of its base, the rod 55 engages into a recess 81 (see FIG. 6) provided in a locking member 8 (FIGS. 1 and 6). This member terminates in a hook 82 which can slide along the bent edge (103-303) of the principal body, which permits the placing of the locking member at any point of the periphery of the throat. A screw 83 assures the fixing of its position. When the threaded rod is engaged into the recess and locked in translation by the element 56, the valve is retained in closed position. A simple push on the element 56 permits the disengagement of the rod, thus permitting the opening of the valve under the effect of its own weight.

It is obvious that various modifications of detail could be made to the throat described and shown, without exceeding the spirit of the invention.

I claim:

1. A prefabricated metallic throat, for connecting the hearth of a chimney to the smoke conduit, said throat comprising two identical plates of a first type assembled by simple interengagement of their edges with the edges of two indentical plates of a second type to form a principal body shaped as a hollow truncated regular pyramid having a rectangular base, said plates of the first type having sections of "C" shape in planes parallel to the base and each forming a side face and two return front and rear faces of the principal body, said plates of the second type joining said return faces to form front and rear faces of the throat, all of said plates being of molded cast iron and each plate having a lower edge bent towards the exterior, the bent edges of the said plates joining between themselves to form a continuous edge for assembly of the chimney hearth, said plates of the second type being trapezium shaped with oblique sides which are inclined at an angle dependent upon the size of the chimney such that the said return faces of the "C" section plates are of a length which does not exceed a predetermined limit compatible with molding of the cast iron without use of a core, the dimensions of the base of the plates of the first type and of the small base of the plates of the second type, and the height of the principal body, remaining constant for throats for different sizes of chimney, said throat further comprising a cap of molded cast iron including a frame for supporting a smoke conduit of the chimney and for supporting an axis for a closing valve, said frame having a skirt fast with the lower face of the frame and surmounting an external surface of an upper edge of said principal body.

2. A throat, as claimed in claim 1, wherein connecting portions between the said side faces and return faces of the plates of the first type are rounded at the joints between the said return faces and the said plates of the second type have a smooth plane surface at the interior of the principal body.

3. A throat as claimed in claim 2, wherein each said joint comprises interfitting male and female parts protruding outwardly of the said smooth plane surface and having flat inner surfaces disposed each in the extension of the other, the said male and female parts bounding therebetween a sinuous airgap having a length adapted to ensure air-tightness of the joint against the passage of smoke, and having a width adapted to permit thermal expansion.

4. A throat as claimed in claim 1, wherein a slideway is mounted on the internal surface of each said side face and an anti-return flow plate is engaged in slidably movable manner in said slideway, projections serving as stop means at the edge of said anti-return flow plate being provided on said internal surface.

5. A throat as claimed in claim 1, wherein said axis of the closing valve is offset with respect to an axis of symmetry of said valve, an edge of said valve nearer said first mentioned axis being arranged to abut on an upper face of a corresponding edge of said frame, an edge of said valve more remote from said first mentioned axis being arranged to abut on a lower face of a corresponding edge of said frame, and wherein means are provided for exerting traction on said valve in the vicinity of said edge nearer to said first mentioned axis to permit closing of said valve.

6. A throat, as claimed in claim 5, wherein said traction means comprise a rod having a lower extremity to engage in a recess in a hook mounted slidably on said bent lower edge.

* * * * *